US007075492B1

(12) United States Patent
Chen et al.

(10) Patent No.: US 7,075,492 B1
(45) Date of Patent: Jul. 11, 2006

(54) HIGH PERFORMANCE REFLECTOR ANTENNA SYSTEM AND FEED STRUCTURE

(75) Inventors: Ming H. Chen, Rancho Palo Verdes, CA (US); Chin Yi Chu, Hsi Chih (TW)

(73) Assignee: Victory Microwave Corporation, Hsi-Chih (TW)

( * ) Notice: Subject to any disclaimer, the term of this patent is extended or adjusted under 35 U.S.C. 154(b) by 0 days.

(21) Appl. No.: 10/908,903

(22) Filed: May 31, 2005

Related U.S. Application Data

(60) Provisional application No. 60/594,552, filed on Apr. 18, 2005.

(51) Int. Cl.
*H01Q 19/10* (2006.01)
*H01Q 13/00* (2006.01)

(52) U.S. Cl. ..... 343/755; 343/781 R; 343/786

(58) Field of Classification Search ..... 343/753, 343/755, 772, 781 R, 781 CA, 786
See application file for complete search history.

(56) References Cited

U.S. PATENT DOCUMENTS

| | | | | |
|---|---|---|---|---|
| 4,963,878 | A | 10/1990 | Kildal | 343/781 P |
| 5,461,394 | A * | 10/1995 | Weber | 343/786 |
| 5,973,652 | A | 10/1999 | Sanford et al. | 343/781 P |
| 6,373,449 | B1 * | 4/2002 | Bokulic et al. | 343/915 |
| 6,429,826 | B1 | 8/2002 | Karlsson et al. | 343/781 P |
| 6,697,027 | B1 | 2/2004 | Mahon | 343/781 CA |
| 6,724,349 | B1 * | 4/2004 | Baird et al. | 343/781 CA |
| 2003/0122719 | A1 | 7/2003 | Nilsson et al. | 343/711 |
| 2005/0062663 | A1 | 3/2005 | Hills | 343/781 P |

* cited by examiner

*Primary Examiner*—Shih-Chao Chen
(74) *Attorney, Agent, or Firm*—Clifford B. Perry

(57) ABSTRACT

A reflector-feed assembly for a reflector dish antenna system includes a feeding waveguide and a reflector plate. The feeding waveguide is operable to support the propagation of a signal therethrough, the feeding waveguide having a major axis along which the signal is propagated, and one or more apertures operable to pass the propagating signal therethrough. The reflector plate is coupled to the feeding waveguide, and extends along a major axis which generally orthogonal to the major axis of the feeding waveguide. The reflector plate includes one or more reflecting surfaces which are positioned to reflect signals passing through the one or more apertures, the one or more reflecting surface extending at an acute angle relative to the feeding waveguide major axis.

20 Claims, 7 Drawing Sheets

| | |
|---|---|
| Dd | 1.37λ |
| Dc | 1.18λ |
| W | 0.94λ |
| A0 | 0.67λ |
| A1 | 0.79λ |
| B0 | 0.13λ |
| B1 | 0.26λ |
| B2 | 0.16λ |
| H | 0.06λ |
| K | 0.22λ |
| M | 0.36λ |
| G | 0.16λ |
| 2 x theta | 120° |

HIGH PERFORMANCE REFLECTOR ANTENNA SYSTEM AND FEED STRUCTURE

CROSS-REFERENCE TO RELATED APPLICATIONS

This application claims the benefit of U.S. Provisional Application No. 60/594,552, filed Apr. 18, 2005, the contents of which are herein incorporated by reference in its entirety for all purposes.

BACKGROUND

The present invention relates generally to antennae systems, and more particularly to reflector antenna systems and feed structures for use therewith.

FIG. 1A illustrates a typical reflector antenna system 100 known in the art consisting of a reflecting dish 110 and an antenna feed structure 120. The reflecting dish 110 is typically of parabolic shape and has an inner concave surface constructed from a material which is highly reflective to the desired signal of operation. The feed 120 is placed at the focus of a parabolic dish for optimal performance in either collecting signal energy reflected from the dish 110, or transmitting signal energy to the dish's surface for subsequent transmission. In this particular configuration, the ratio of the reflector's focal distance to diameter f/D is greater than 0.25, a typical ratio being, for example, 0.5.

FIG. 1B illustrates the antenna pattern of the conventional feed 120 displaying E and H-plane signal responses. As shown, the edge of illumination at −10 dB is 106 degrees, representing the typical operational range from bore sight over which the antenna can transmit and receive signals.

FIG. 1C illustrates a high performance reflector antenna system 150 known in the art used to address the side lobe generation problem. In such a system, a shroud 160 is placed around the periphery of the reflector dish 110, and a radome 170 or other signal transparent material is used to enclose the feed structure 120 in the system. The shroud 160 includes a signal absorbing material on its inner surface for attenuating signals reflected from the feed structure 120. The result is reduced side lobe degradation, but at the cost of reduced antenna gain. Further, the improved antenna system 150 is even more limited in its field of view compared to the conventional system 100 because of the use of the shroud structure 160.

What is needed is a reflector antenna system which exhibits low side lobe performance without the use of absorbing material.

SUMMARY

The invention presents a reflector antenna system and corresponding reflector-feed assembly which provide a low f/D ratio, an extended angle of viewing, and low side lobe performance. The low f/D ratio allows the feed structure to be located below the rim of the reflector dish in order to more conveniently cover and protect the dish from environmental elements. Further, because the reflector-feed assembly is located below the rim of the reflector, no signal can reach the feed directly, and low side lobe performance can be obtained.

In a particular embodiment, the reflector-feed assembly includes a feeding waveguide and a reflector plate. The feeding waveguide is operable to support the propagation of a signal therethrough, the feeding waveguide having a major axis along which the signal is propagated, and one or more apertures operable to pass the propagating signal therethrough. The reflector plate is coupled to the feeding waveguide, and extends along a major axis which generally orthogonal to the major axis of the feeding waveguide. The reflector plate includes one or more reflecting surfaces which are positioned to reflect signals passing through the one or more apertures, the one or more reflecting surface extending at an acute angle relative to the feeding waveguide major axis.

These and other features of the present invention will be better understood when read in view of the following drawings and detailed description.

For clarity, previously identified features retain their reference indicia in subsequent drawings.

DETAILED DESCRIPTION OF EXEMPLARY EMBODIMENTS

Figure 2A:
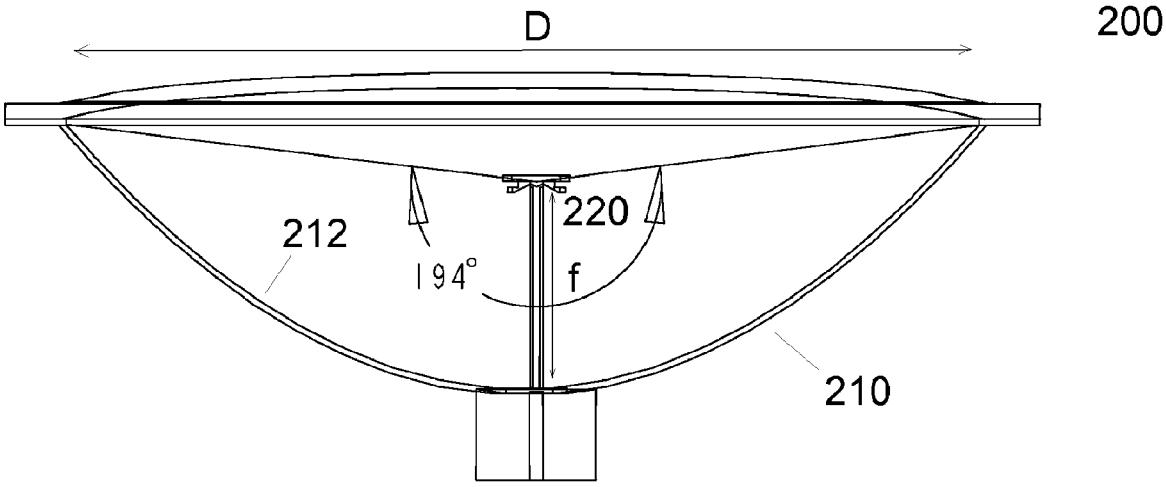
FIG. 2A illustrates a reflector antenna system in accordance with one embodiment of the present invention.

FIG. 2A illustrates a reflector antenna system 200 in accordance with one embodiment of the present invention. The antenna system 200 includes a reflector dish 210 and a reflector-feed assembly 220. The reflector dish 210 includes a concave inner surface 212 operable to reflect signals of interest to and from the focal point where the reflector plate (illustrated below) is located. In a particular embodiment, the reflector dish 210 is generally parabolic in shape, although variations on this shape may be employed in alternative embodiments. The reflector dish 210 may be constructed from numerous materials, and be of solid or meshed design, depending upon the desired frequency of operation and performance parameters. For example, materials, such as aluminum, steel, molded plastic with conducting mesh, as well as other materials and configurations may be used.

In an exemplary embodiment, the reflector dish 210 is defined by a diameter D, and focal distance f, at which the feeding waveguide 220 of the present invention is positioned. The ratio of f/D in an exemplary embodiment is less than 0.25, and in a particular embodiment is 0.22.

Figure 2B:
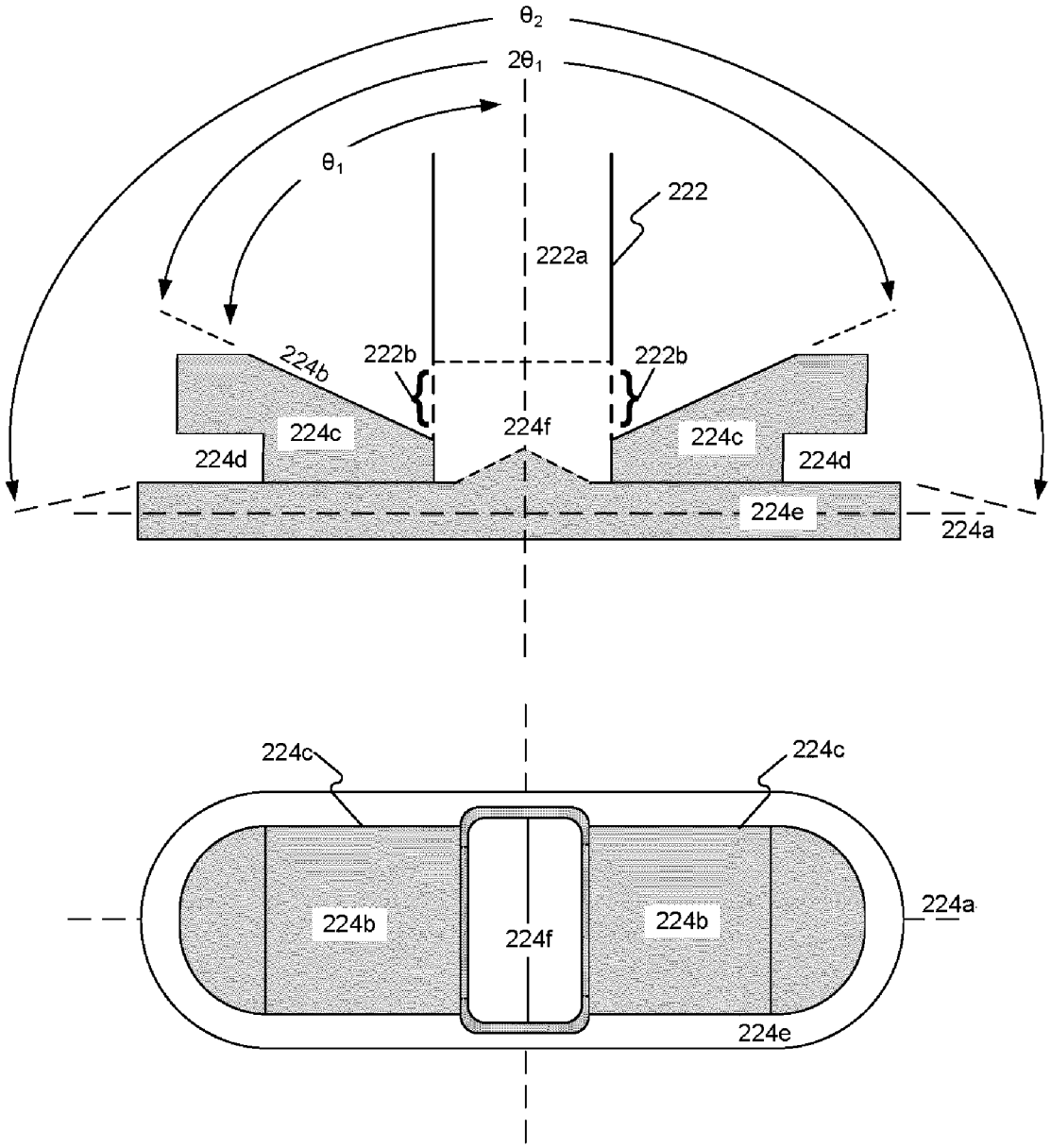
FIG. 2B illustrates an embodiment of a reflector-feed assembly in accordance with the present invention.

FIG. 2B illustrates an exemplary embodiment of the reflector-feed assembly 220 in accordance with the present invention, shown in top and side views. The reflector-feed assembly 220 includes a feeding waveguide 222 extending from the concave inner surface of the reflector dish 210, and a reflector plate 224 located at the focal point of the reflector dish 210. The feeding waveguide 222 extends along a major axis 222*a* and is configured to support the propagation of a signal either received from the reflector plate 224 during a receiving operation, or transmitted to the reflector plate 224 during a transmission operation. In the illustrated embodiment, the feeding waveguide 222 is a rectangular waveguide for transmitting or receiving a linearly-polarized E field signal. Further, different materials may be used to construct the feed guide 222, examples being brass, aluminum, die cast metals (e.g., aluminum), molded plastic having a conductive surface, and the like.

The feeding waveguide 222 further includes one or more apertures 222*b* through which the desired signal passes. In an exemplary embodiment, two laterally-opposed apertures are provided, although in alternative embodiments under the present invention, one aperture may be used, or three or more apertures employed. The dimensions of the apertures are determined by the desired frequency of operation, exemplary dimensions of which are provided below.

The reflector plate 224 is coupled to communicate signals to and from the feeding waveguide 222. In the particular embodiment shown, the reflector plate 224 is physically connected to the feeding waveguide 222. In such an embodiment, the feeding waveguide 222 and the reflector plate 224 may be individually manufactured and fastened together, or integrally formed. Alternatively, the feeding waveguide 222 and the reflector plate 224 are spaced apart and oriented relative to one another to couple the desired signal between the two structures.

The reflector plate 224 in an exemplary embodiment is constructed in generally a rectangular shape along a major axis 224*a* corresponding to the desired E field signal communicated, the reflector plate major axis being generally orthogonally to the major axis of the feeding waveguide 222*a*. In this particular embodiment, the rectangular-shaped reflector plate of the present invention presents a smaller cross-section to on-bore sight reception compared to a circular-shaped sub-reflector, and accordingly provides minimum feed blockage and higher antenna gain.

The reflector plate 224 further includes one or more reflecting surfaces 224*b* positioned to reflect signal exiting from, or entering into the one or more apertures 222*b*. The one or more reflecting surfaces 224*b* reflect signals exiting from the one or more apertures to the concave inner surface of the reflector dish, and accordingly to the far field during a transmission operation. During a receiving operation, received signals are reflected by the concave inner surface 212 of the reflector dish to the focal point where the reflector plate 224 is located. The one or more reflecting surfaces 224*b* reflect at least a portion of that signal through the one or more apertures 222*b*, into the feed guide 222, and onto connecting receiving circuitry.

As illustrated, the one or more reflecting surfaces 224*b* extend at an acute angle $\theta_1$ (i.e., less than 90 degrees) relative to the feed guide major axis 222*a*, and in the direction toward the inner surface of the reflector dish. Generally, the acute angle ranges between 30 degrees and 80 degrees, and in a particular embodiment is substantially 60 degrees. In the latter embodiment, the angular separation between the two laterally-opposed reflecting surfaces is substantially 120 degrees.

In the exemplary embodiment shown, the reflector plate 224 further includes an edge choke 224*d* which is formed between the reflecting surface structure 224*c* and a splash pate 224*e*. The edge choke 224*d* is operable to prevent surface currents present along the reflection surface 224*b* from migrating to the splash plate 224*e*, where these currents could create signal components propagating into the far field. In the particular embodiment shown, two edge choke portions are formed corresponding to the two reflecting surfaces. In an alternative embodiment in which fewer or a greater number of reflecting surfaces are provided, a corresponding fewer or greater number of edge chokes are also provided. Further, the reflecting surface structure 224*c* and splash plate 224*e* may be either separately formed and attached, or integrally formed. The edge choke depth is typically one quarter wavelength as defined by the frequency of operation, and an example embodiment of its dimensions is provided below.

In a particular embodiment, the sub-reflector splash plate 224*e* includes an impedance matching portion 224*f*. In one embodiment, this portion 224*f* comprises a raised taper which extends into the feed guide 222. Other embodiments of the impedance matching portion 224*f* include a stepped structure, or other impedance matching shapes known in the art. The combined features of the lateral edge-to-edge length of the reflecting surfaces 224*b* and length of splash plate 224*e* operate to provide a dish illumination angle $\theta_2$ greater than $\theta_1$.

Exemplary Embodiment

Figure 3A:
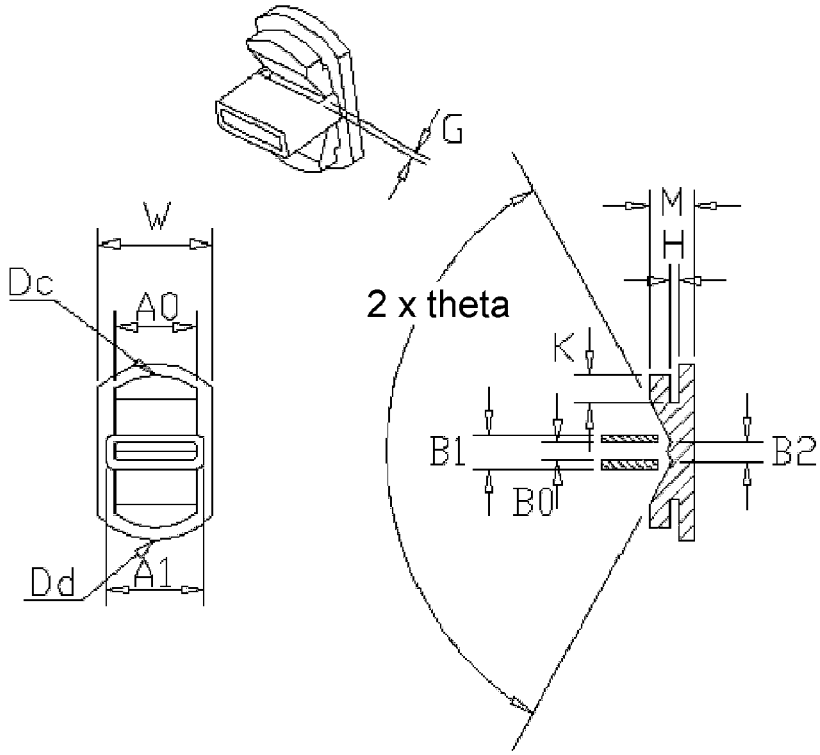
FIG. 3A illustrates a detailed exemplary embodiment of the reflector-feed assembly in accordance with the present invention.

FIG. 3A illustrates an exemplary embodiment of the reflector-feed assembly 220 in accordance with the present invention, the dimensions being indicated as a function of wavelength, or equivalently, frequency of operation. Dimension W controls the H-plane beamwidth, and 2θ is used for E-plane beamwidth control. Dimensions H and K define the characteristics of the edge choke 224*d* for reducing backward E-plane radiation. Dimension G defines the size of the apertures 224*b*, and Dd defines the outer radius of the splash plate 224*e*. Dimensions Dc and A0 define the outer radius and width of the reflecting surface structure 224*c*, respectively. Dimensions A1, B0 and B1 represent illustrated dimensions for the feeding waveguide 222. Dimension B2 represents the lateral width of the impedance matching portion 224*f*, and dimension M represents the vertical height of the reflector plate 224. As can be seen, the major dimension of the reflector plate 224, defined by Dd, is very small, 1.37 λ, thereby presenting minimal feed blockage and consequently low side lobe distortion and high antenna gain.

Figure 1A:
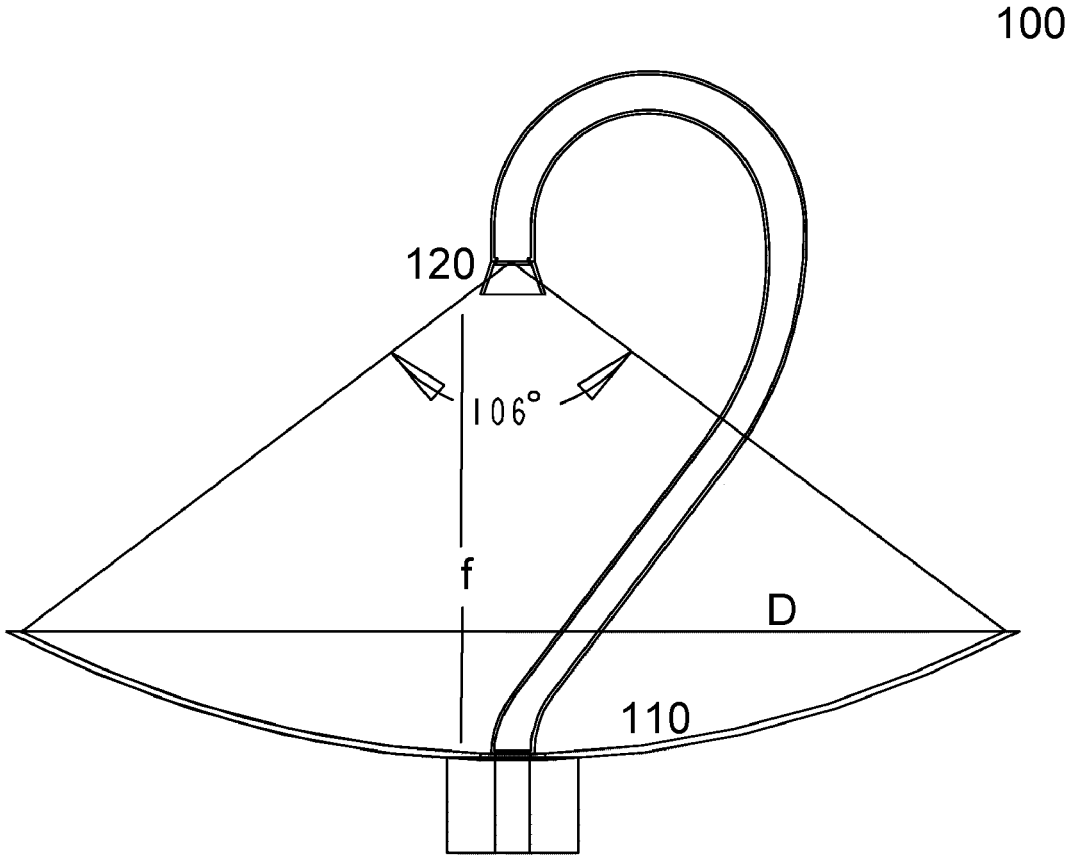
FIGS. 1A–1B illustrate conventional reflector antenna systems and corresponding antenna patterns known in the art.
Figure 1B:
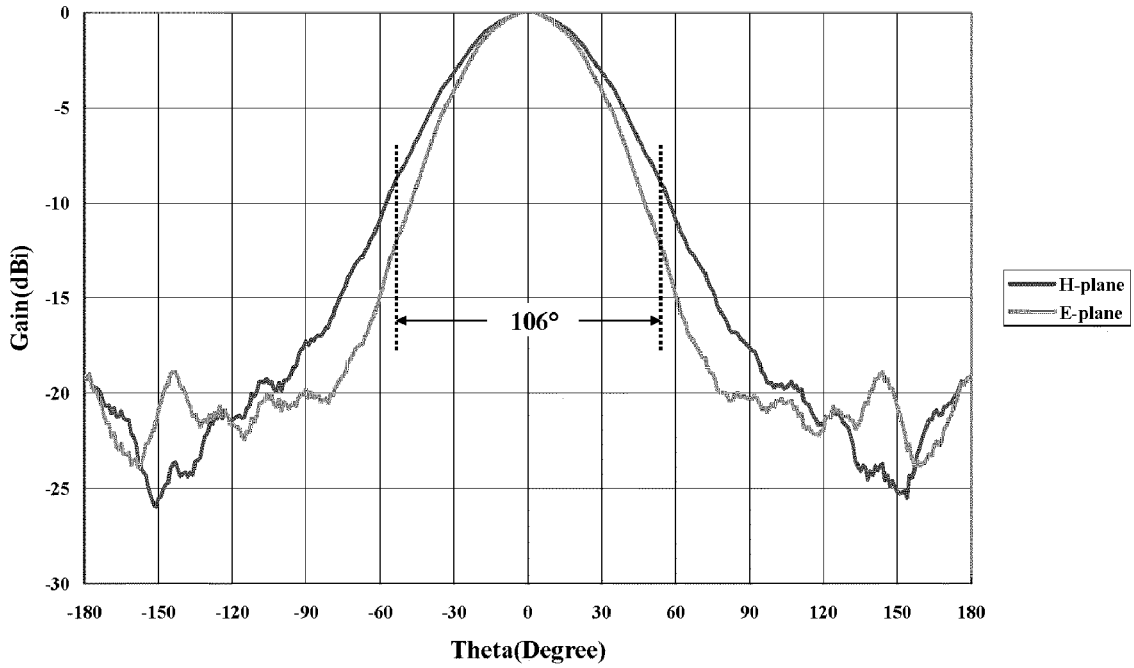
Figure 1C:
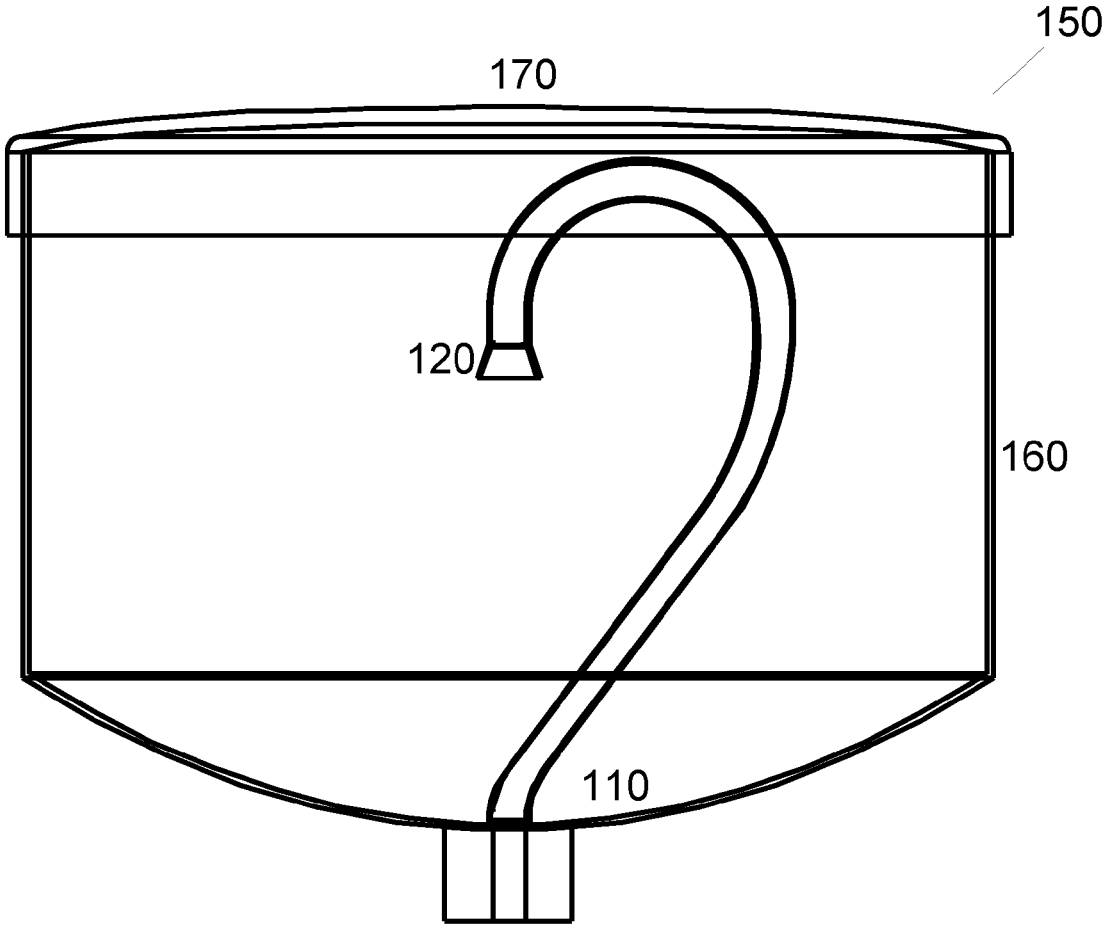
FIG. 1C illustrates a high performance reflector antenna system known in the art.
Figure 3B:
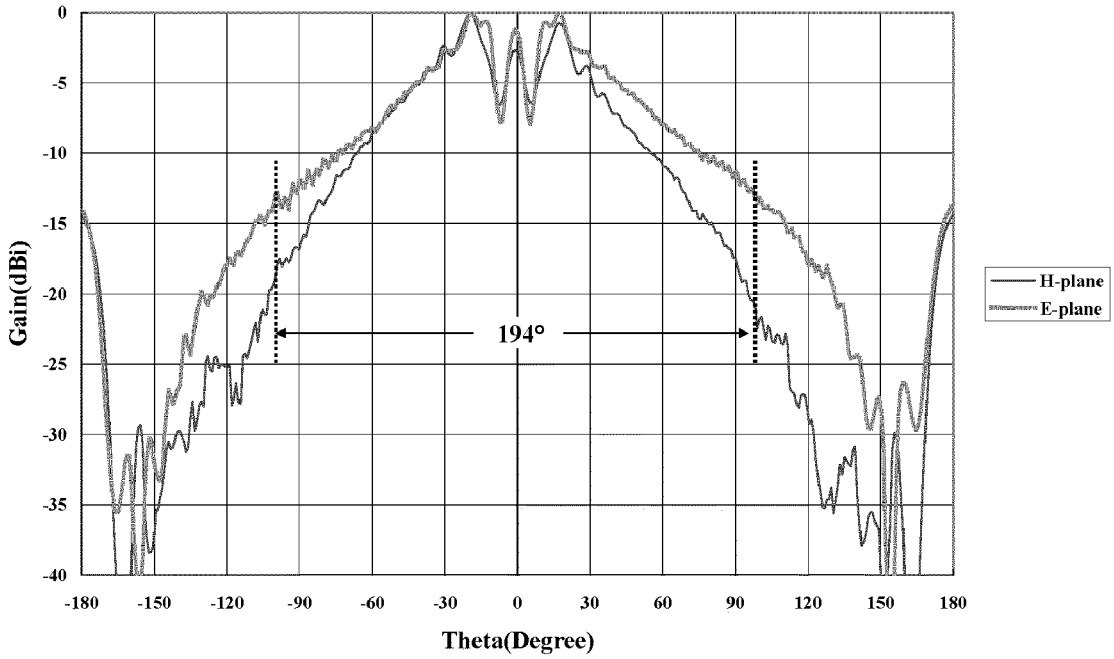
FIG. 3B illustrates the antenna pattern for the reflector-feed assembly shown in FIG. 3A.

FIG. 3B illustrates the antenna pattern for the reflector-feed assembly shown in FIG. 3A, the graph displaying E and H-plane signal responses. As can be seen, the edge of antenna illumination is approximately 194 degrees, which represents a substantially wider field of view compared to the conventional antenna feed 120 shown in FIGS. 1A–C.

Figure 3C:
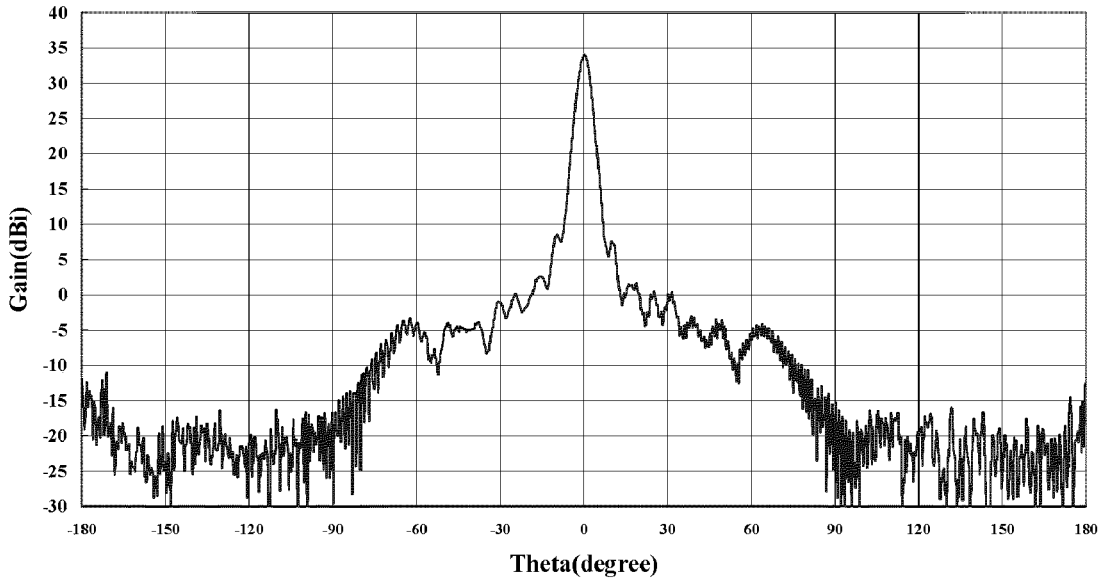
FIG. 3C illustrates a far field antenna pattern of an exemplary reflector antenna system employing the sub-reflector feed structure of FIG. 3A.

FIG. 3C illustrates a far field antenna pattern showing the directivity and side lobe performance of a reflector antenna system employing the reflector-feed assembly of FIG. 3A. In the exemplary embodiment shown, a 33 cm parabolic reflector dish constructed from aluminum and is implemented at an operating frequency of 18.75 GHz, the graph displaying the response of a vertically polarized signal. As can be seen, side lobe performance of the antenna system is quite good, —35 dB @ 30 degrees off bore sight.

The foregoing description has been presented for purposes of illustration and description. It is not intended to be exhaustive or to limit the invention to the precise form disclosed, and obviously many modifications and variations are possible in light of the disclosed teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A reflector-feed assembly for use with a reflector dish antenna, the reflector-feed assembly comprising:

a feeding waveguide configured to support the propagation of a signal therethrough, the feeding waveguide having a major axis along which the signal is propagated and one or more apertures operable to pass said signal therethrough; and a reflector plate coupled to the feeding waveguide, the reflector plate comprising a major axis generally orthogonal to the major axis of the feeding waveguide, the reflector plate including one or more reflecting surfaces positioned to reflect signals passing through said one or more apertures, said one or more reflecting surface extending at an acute angle relative to the feed guide major axis.

2. The reflector-feed assembly of claim 1, wherein the feeding waveguide comprises a rectangular waveguide operable to support the propagation of a linearly polarized signal.

3. The reflector-feed assembly of claim 1, wherein the reflector plate comprises a major axis and a minor axis.

4. The reflector-feed assembly of claim 1, wherein the reflector plate further comprises an edge choke.

5. The reflector-feed assembly of claim 4, wherein the edge choke is formed exclusively along the major axis of the reflector plate.

6. The reflector-feed assembly of claim 1, wherein the signal comprises a signal selected from the group consisting of a vertically-polarized signal and a horizontally-polarized signal.

7. The reflector-feed assembly of claim 1, wherein the feeding waveguide and the reflector plate comprise a single integrally-formed structure.

8. The reflector-feed assembly of claim 1, wherein the acute angle along which the reflecting surface of the reflector plate comprises an angle within the range of 30 degrees to 80 degrees.

9. The reflector-feed assembly of claim 8, wherein the acute angle comprises substantially 60 degrees.

10. A reflector antenna system, comprising:

a reflector dish having a concave inner surface; and a reflector-feed assembly positioned to receive a signal from, or to transmit a signal to the concave inner surface of the dish reflector, the reflector-feed assembly further comprising:

a feeding waveguide configured to support the propagation of the signal therethrough, the feeding waveguide having a major axis along which the signal is propagated and one or more apertures operable to pass said signal therethrough; and a reflector plate coupled to the feeding waveguide, the reflector plate comprising a major axis generally orthogonal to the major axis of the feeding waveguide, the reflector plate including one or more reflecting surfaces positioned to reflect signals emanating from said from said one or more apertures, said one or more reflecting surface extending at an acute angle relative to the feeding waveguide major axis.

11. The reflector antenna system of claim 10, wherein the reflector dish comprises a diameter D, and the reflector plate is positioned at a focal distance f from the reflector dish, and wherein the ratio of the focal distance to the reflector dish diameter f/D is less than 0.25.

12. The reflector antenna system of claim 10, wherein the reflector dish is generally parabolic in shape.

13. The reflector antenna system of claim 10, wherein the reflector plate comprises a minor axis and a major axis.

14. The reflector antenna system of claim 10, wherein the reflector plate further comprises an edge choke.

15. The reflector antenna system of claim 14, wherein the edge choke is formed exclusively along the major axis of the reflector plate.

16. The reflector antenna system of claim 10, wherein the signal comprises a signal selected from the group consisting of a vertically-polarized signal and a horizontally-polarized signal.

17. The reflector antenna system of claim 10, wherein the feeding waveguide and the reflector plate comprise a single integrally-formed structure.

18. The reflector antenna system of claim 10, wherein the acute angle along which the reflecting surface of the reflector plate comprises an angle within the range of 30 degrees to 80 degrees.

19. The reflector antenna system of claim 18, wherein the acute angle comprises substantially 60 degrees.

20. The reflector antenna system of claim 11, wherein the f/D ratio is substantially 0.22.

* * * * *